United States Patent [19]

Schmolke

[11] Patent Number: 4,862,688

[45] Date of Patent: Sep. 5, 1989

[54] OPENING CYLINDER FOR OPEN-END SPINNING MACHINE

[75] Inventor: Karl H. Schmolke, Neuweiler, Fed. Rep. of Germany

[73] Assignee: Hollingsworth GmbH, Neubulach, Fed. Rep. of Germany

[21] Appl. No.: 246,564

[22] Filed: Sep. 19, 1988

[30] Foreign Application Priority Data

Oct. 12, 1987 [DE] Fed. Rep. of Germany ..... 8713692

[51] Int. Cl.[4] ..... D01H 7/895; D01G 19/10

[52] U.S. Cl. ..... 57/408; 19/112; 19/97

[58] Field of Search ..... 57/408; 19/97, 112, 19/105, 144

[56] References Cited

U.S. PATENT DOCUMENTS

| | | | |
|---|---|---|---|
| 3,324,642 | 6/1967 | Meimberg | 57/408 |
| 3,646,639 | 3/1972 | Burckhardt et al. | 19/97 |
| 3,775,956 | 12/1973 | Rajnoha et al. | 57/408 |
| 4,044,427 | 8/1977 | Ankrom et al. | 19/112 X |
| 4,208,767 | 6/1980 | Schmolke | 19/112 X |
| 4,272,865 | 6/1981 | Schmolke | 19/97 |
| 4,301,572 | 11/1981 | Miyamoto | 19/97 |
| 4,394,789 | 7/1983 | Egerer | 19/97 |
| 4,574,583 | 3/1986 | Stahlecker et al. | 57/408 |
| 4,625,366 | 12/1986 | Egerer | 19/97 |
| 4,627,131 | 12/1986 | Iwata | 19/97 |

OTHER PUBLICATIONS

European Search Report EP 3983-201/be, Application No. 87117690.5-.

*Primary Examiner*—Donald Watkins

*Attorney, Agent, or Firm*—Townsend and Townsend

[57] ABSTRACT

An opening cylinder for an open-end spinning machine comprising a cylinder body of aluminum or similar material having a helical groove therein for receiving the foot portion of a saw-tooth wire fillet wherein the width of the groove is smaller than the foot portion of the saw-tooth wire fillet and the material of opening cylinder is deformed by press-rolling the wire fillet into the grooves.

8 Claims, 3 Drawing Sheets

OPENING CYLINDER FOR OPEN-END SPINNING MACHINE

DESCRIPTION

Figure 1:
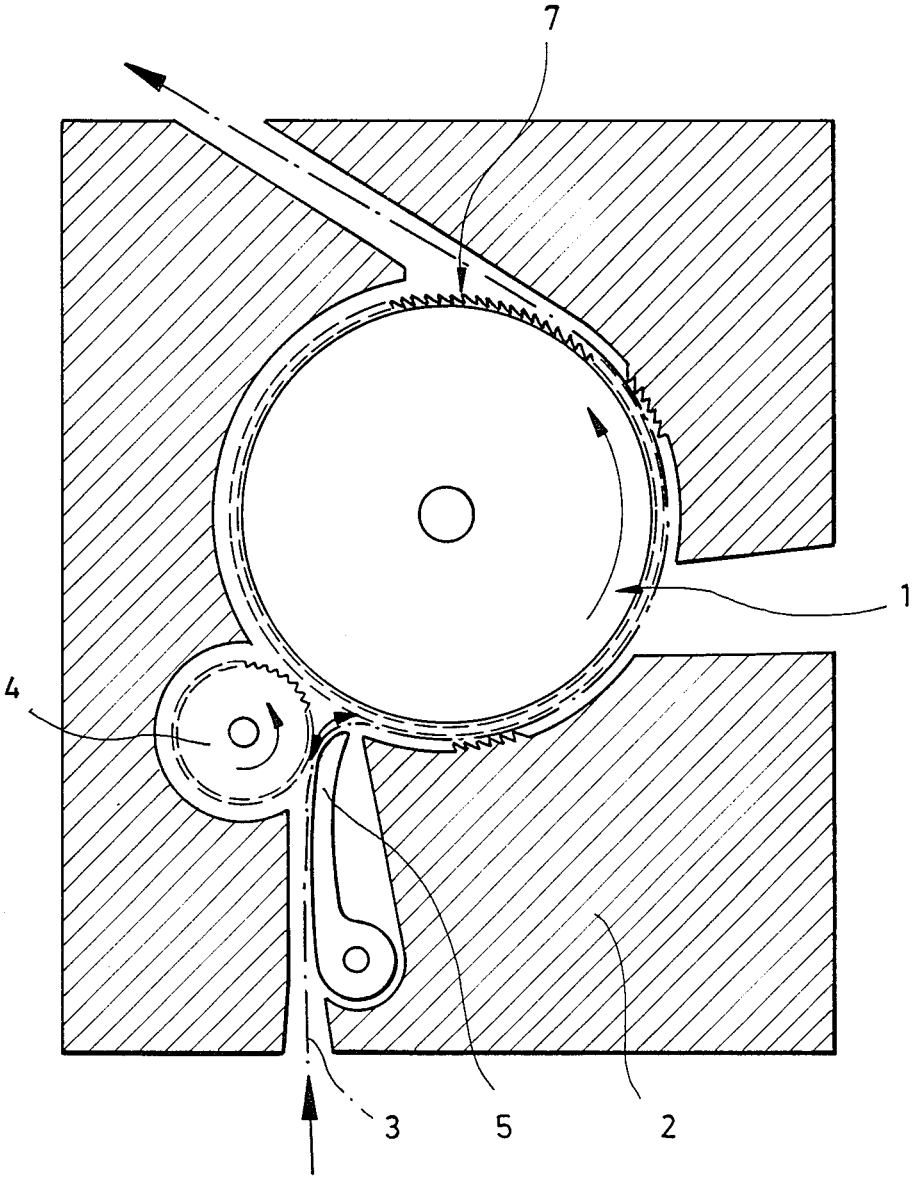

The present invention relates to an opening cylinder for an open-end spinning machine, comprising a saw-tooth wire fillet and a cylinder body of aluminum or a similar material, the circumferential surface of said cylinder body being formed with a helical groove for receiving a foot portion of said saw-tooth wire therein.

An opening cylinder of this type for use in an open-end spinning machine has been known for some time from practical use. The saw-tooth wire has a foot portion of considerable height which is completely received in an excessively deep groove formed in the cylinder body. In the known opening cylinder, the height of the foot portion of the saw-tooth wire accounts for about ⅓ to ½ of the total height of the saw-tooth wire. After bending the saw-tooth wire and inserting it into the groove, the lands between adjacent windings of the helical groove are permanently deformed by a press-rolling operation, so that the gap remaining between the foot portion of the saw-tooth wire and the walls of the groove disappears.

The known opening cylinder thus permits the gap-free mounting of the saw-tooth wire on the circumferential surface of the cylinder body. This is important, as the fibres to be spun might otherwise be caught in existing gaps to thereby impair the proper opening of the supplied fibre web. There is the disadvantage, however, that the true-running properties of the known opening cylinder are no longer adequate to modern requirements. The press-rolling of the lands between adjacent windings of the groove results in the foot portion of the saw-tooth wire being slightly squeezed out of the groove at some locations. This slight displacement of the saw-tooth wire does not impair its attachment to the cylinder body, but makes it appear impossible to mount the opening cylinder in closest proximity to the feeder table. This possibility is demanded. however, by many textile manufacturers for obtaining yarns of especially high quality.

From CH-PS 581,209 there is also known an opening cylinder having a fillet mounted on a grooveless cylinder body. Although this opening roller permits a substantially equal height of the tips of all teeth to be achieved, resulting in highly accurate true-running properties, this opening cylinder gives rise to a different problem. When the saw-tooth wire is bent to the helical configuration, the beinding does not take place in a uniform manner. More specifically, the bends in the saw-tooth wire are essentially formed only between adjacent teeth thereof, because the bending resistance at the locations of the teeth themselves is a multiple of that between the teeth. This results in the foot portion of the saw-tooth wire being stretched between adjacent teeth. This leads to the formation of constrictions between adjacent teeth, and results in the bottom side of the foot portion being bent not to a circular shape, but rather to a polygonal shape. This effect is also known as the polygon effect. This behaviour of the saw-tooth wire during the bending operation results in the formation of gaps between the bottom surface of the saw-tooth wire and the circumferential surface of the cylinder body, with the possibility of fibres getting caught in these gaps. Particularly susceptible to this occurrence are polyester fibres.

Proceeding from these inherent problems of prior art constructions, it is an object of the present invention to provide an opening cylinder of the type defined in the introduction having improved true-running properties, without the formation between the saw-tooth wire and the cylinder body of gaps in which fibres might get caught. According to the invention this object is attained by the provision that prior to the insertion of the saw-tooth wire the width of the groove at least at its upper edges is slightly smaller than that of the foot portion of the saw-tooth wire.

This solution offers the advantage that after the insertion of the saw-tooth wire the latter does no longer have to be secured in the groove by a press-rolling operation. To the contrary, the saw-tooth wire is simply inserted so as to be supported on the bottom of the groove. The true-running properties of the thus constructed opening cylinder are therefore the same as those of the known non-grooved opening cylinder. As a result of the width of the groove being smaller than that of the foot portion of the saw-tooth wire, the material of the lands between adjacent grooves is laterally displaced, so that on the one hand a clamping effect is obtained for retaining the saw-tooth wire, and that on the other hand the lands are shaped to conform to the outer contours of the foot portion as the saw-tooth wire is being inserted into the groove. This is of importance in view of the formation of constrictions between adjacent teeth of the saw-tooth wire as the latter is being bent prior to its insertion into the groove. At these locations the width of the foot portion of the saw-tooth wire is smaller by about 2% than prior to the operation of bending the saw-tooth wire. In view of the fact that the width of the groove is smaller than that of the foot portion of the saw-tooth wire, the material of the lands is displaced substantially only at the locations of greater width of the foot portion. As a result, there remains no gap between the groove's edges and the foot portion of the saw-tooth wire, so that even very fine fibres cannot be caught. With the opening cylinder according to the invention it is thus possible for the first time to mount the opening cylinder in close proximity to the feeder table also when processing polyester fibres. In this context it is to be noted that this capability is not achived by a complicated construction.

According to an advantageous embodiment of the invention, the groove is of a width substantially corresponding to that of constrictions formed in the foot portion of the saw-tooth wire between adjacent teeth thereof as the sawtooth wire is being bent about the cylinder body. This dimensioning of the groove's width is already sufficient for ensuring reliable retention of the saw-tooth wire in the groove and a gap-free mounting of the saw-tooth wire. The width of the groove is preferably smaller by about 3% than the foot portion of the foot portion of the saw-tooth wire before bending. These 3% substantially correspond to the constriction of the foot portion between adjacent saw teeth formed by bending the saw-tooth wire.

When the groove is formed as a dovetail groove having undercut edges, the groove's edges are brought into particularly effective engagement with the foot portion of the saw-tooth wire. The upper edges of the groove thus have the effect of sealing lips.

For obtaining this sealing lip effect is is already sufficient when the width of the groove bottom is greater by about 2% than the clearance between the groove's edges.

The depth of the groove may be kept relatively small by comparison to prior art constructions. For obtaining favourable true-running properties, the depth of the groove is advantageously selected to be about 1% to ½ of its width. This is advantageous for achieving a reliable and gap-free mounting of the saw-tooth wire and for ensuring that the foot portion of the saw-tooth wire is supported throughout on the bottom of the groove, resulting in highly accurate true-running properties.

It has been found to be particularly advantageous to select a groove depth of about ⅓ of the groove's width. The height and the width of the foot portion of the saw-tooth wire are both preferably about 1 mm.

Figure 2:
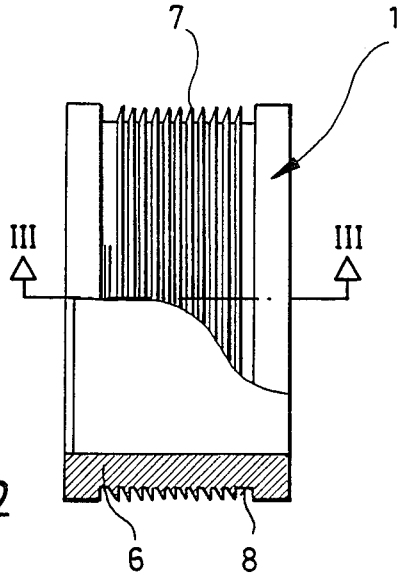
Figure 5:
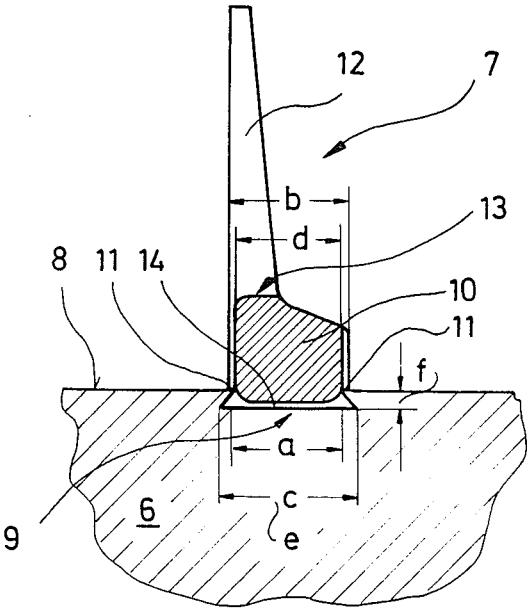
Figure 3:
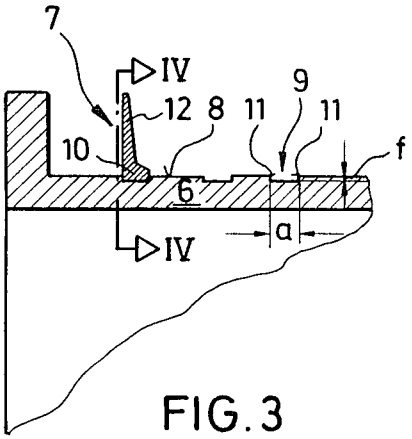
Figure 4:
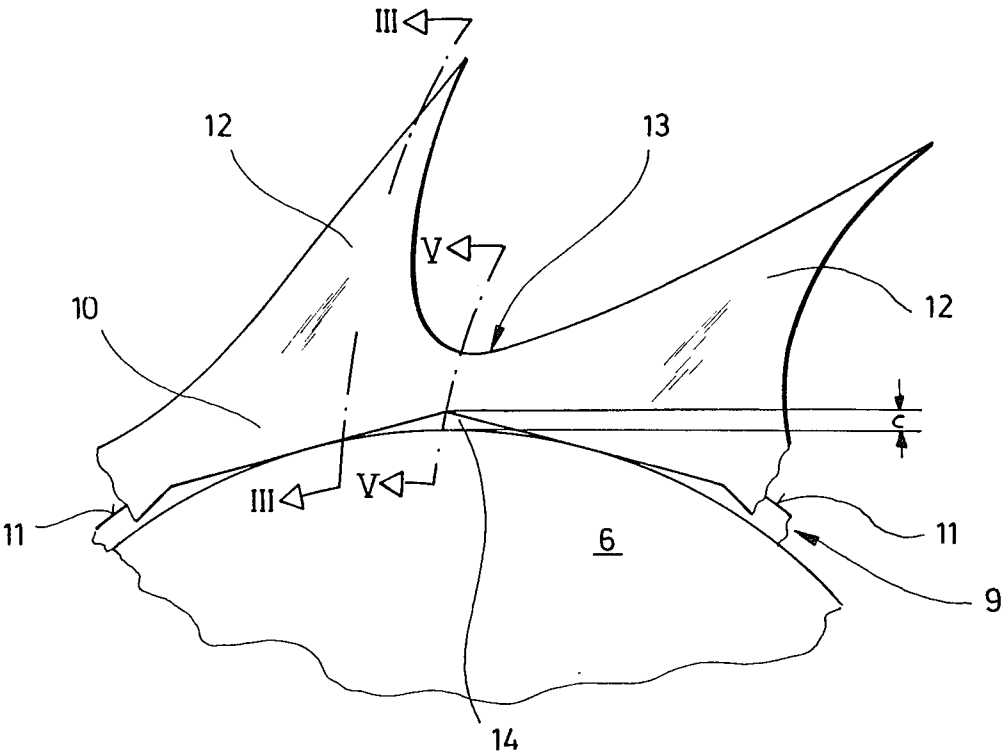

An embodiment of the invention shall now be described by way of example with reference to the accompanying drawings, wherein:

FIG. 1 shows a diagrammatic illustration of an opening cylinder in its mounted state, FIG. 2 shows a partially sectioned sideview of the opening cylinder shown in FIG. 1, FIG. 3 shows an enlarged cross-sectional view of a portion of the opening cylinder shown in FIG. 2, taken along the line III—III in this figure, FIG. 4 shows a still further enlarged cross-sectional view of a portion of the opening cylinder, taken along the line IV—IV in FIG. 3, and FIG. 5 shows a cross-sectional view of the foot portion of a saw-tooth wire mounted in a groove of the opening cylinder, taken along the line V—V in FIG. 4.

Shown in FIG. 1 is an opening cylinder 1 according to the invention for an open-end spinning machine, with the main components associated therewith.

These components include a housing 2 formed with feeding passages for a fibre web 3 to be opened. Provided at the inlet side of opening cylinder 1 are a feeder circuit 4 and a feeder table 5. Feeder table 5 is adjustable in directions towards opening cylinder 1 and away therefrom, and can be advanced into close proximity to opening cylinder 1.

In FIG. 2 opening cylinder 1 is shown separately. As shown in this figure, opening cylinder 1 comprises a cylinder body 6 and a saw-tooth wire fillet 7 mounted on the circumferential surface thereof. Saw-tooth wire 7 is mounted in a helical configuration on the circumferential surface 8 of cylinder body 6.

As shown in FIGS. 3 and 4, saw-tooth wire 7 has a foot portion 10 received in a helical groove 9 formed in the circumferential surface 8 of cylinder body 6.

The width a of groove 9 is smaller at least at its upper edges 11 than the width b of foot portion 10 of saw-tooth wire 7 prior to its mounting in groove 9.

These relationships will be explained with particular reference to FIG. 4, showing a section of saw-tooth wire 7 in its bent state. The illustration of FIG. 4 is somewhat exaggerated for better understanding. As the saw-tooth wire 7 is being bent, the bending of the foot portion 10 does not proceed in a uniform manner, but is rather concentrated at the locations between adjacent teeth 12 of the saw-tooth wire 7. As a result, the bottom surface of foot portion 10 is bent to a polygonal shape. This effect is also known as the polygon effect. Underneath the tooth interstices 13 there is thus formed a gap 14 having a height c.

Due to the concentration of the bending in the interstices 13 between adjacent teeth 12, foot portion 10 is stretched at these locations. This results in the formation of constrictions of a width d as indicated in FIG. 5.

As shown in FIG. 5, the clearance between the upper edges 11 of groove 9 prior to the insertion of saw-tooth wire 7 is of a width substantially corresponding to that of the constrictions described above. That is, the width a of the groove adjacent its upper edges corresponds to the width d of the constriction formed at the location of a tooth interstice 13.

The width of groove 9 between its upper edges 11 is smaller by about 3% than that of foot portion 10 of saw-tooth wire 7 before binding. Since practically no bending occurs in foot portion 10 at the location of teeth 12, the groove width a is smaller by about 3% than the width b of the foot portion at the location of a tooth 12.

As shown particularly clearly in FIG. 5, the groove of the illustrated embodiment is formed as a dovetail groove 9 with undercut upper edges 11. The width of the groove's bottom is greater by about 3% than the clearance between upper edges 11. This means that this width e is greater by about 3% than width a, and thus substantially corresponds to width b.

In the not yet bent state of the saw-tooth wire 7 employed in this embodiment, the width b of foot portion 10 is about 0.96 mm, foot portion 10 having a substantially square cross-sectional shape. The width of a constriction d at the location of a tooth interstice 13 is 0.94 mm. The depth f of groove 9 is preferably selected to be between about 1/5 to ½ of groove width a. In the embodiment shown, groove depth f is about 0.3 mm. The width a of groove 9 adjacent upper edges 11 is 0.94 mm. The gap height c is about 0.2 mm in the case of the saw-tooth wire employed in this embodiment.

As saw-tooth wire 7 is being inserted into the groove 9 dimensioned as indicated above, the material of upper edges 11 is laterally displaced by foot portion 10 at the location of teeth 12. As a result the upper groove edges are shaped to closely conform to the sides of foot portion 10. At the location of tooth interstices 13, i.e. of the constrictions formed by the bending operation, the material of the upper edges 11 is not displaced in the embodiment shown, as the saw-tooth wire fits into the groove at these locations. Since the gap height c is smaller than the groove's depth f, the saw-tooth wire 7 is retained in the groove 9 without the formation of gaps at the location of the constrictions. The individual teeth 12 are supported on the bottom of the groove at the same relative locations, so that all teeth are of the same height.

The thus constructed opening cylinder 1 permits feeder table 5 to be advanced to a spacing of 0.1 mm or even less. At the same time this opening cylinder is suitable for processing particularly difficult fibres, such as polyester fibres of less than 3 deniers, without the danger of fibres getting caught between the edges of groove 9 and foot portion 10 of saw-tooth wire 7.

Although the groove provided in the described embodiment is formed as a dovetail groove, it is also possible to form the groove with vertical walls to thereby simplify the groove-forming operation.

The cylinder body 6 consists of aluminum or an aluminum alloy.

Any pockets remaining between the constrictions of the foot portion of the saw-tooth wire and the groove edges due to manufacturing tolerances of the saw-tooth wire can be closed in an advantageous manner by spraying the opening cylinder with an insulating varnish of the type known from the field of electric engineering.

This varnish, to be obtained for instance from Messrs. Kontakt-Chemie, Rastatt under the name of "Plastik 70", kreeps into any remaining pockets and solidifies therein.

I claim:

1. An opening cylinder for an open-end spinning machine, comprising:

a sawtooth wire fillet having a foot portion defining a foot width; and a cylinder body made of an aluminum containing metal, said body having a circumferential surface defining a helical groove for receiving the foot portion of the sawtooth wire fillet therein;

said groove, prior to receiving said foot portion, having a depth and a width, said width at an upper edge on said circumferential surface being slightly smaller than the foot width of said sawtooth wire fillet;

a portion of said circumferential surface adjacent said groove becoming laterally displaced as the sawtooth wire is forced radially into said groove so as to secure the sawtooth wire in place without formation of a substantial gap between the sawtooth wire and said circumferential surface.

2. An opening cylinder according to claim 1, wherein said sawtooth wire fillet is bent about said cylinder body, and said foot portion forms restrictions between adjacent teeth, said width of said groove substantially corresponding to a width of said restrictions.

3. An opening cylinder according to claim 1, wherein said width of said groove, prior to bending said sawtooth wire fillet about said cylinder body, is about 3% smaller than said foot width.

4. An opening cylinder according to claim 1, wherein said helical groove is formed as a dovetail groove having undercut edges.

5. An opening cylinder according to claim 1, wherein a bottom width of said groove is greater by about 3% than the groove width at an upper edge on said circumferential surface.

6. An opening cylinder according to claim 1, wherein said groove depth is about 20% to about 50% of the groove width at an upper edge on said circumferential surface.

7. An opening cylinder according to claim 1, wherein said groove depth is about 33% of the groove width at an upper edge on said circumferential surface.

8. An opening cylinder according to claim 1, wherein a height and the width of said foot portion of said sawtooth wire fillet are each about 1 mm.

* * * * *